US006712488B2

(12) United States Patent
Lee et al.

(10) Patent No.: US 6,712,488 B2
(45) Date of Patent: Mar. 30, 2004

(54) GLOBE TYPE ELECTRODELESS LIGHTING APPARATUS

(75) Inventors: Jae-Jin Lee, Seoul (KR); Young-Jin Bae, Daegu (KR); Geun-Young Park, Gumi (KR)

(73) Assignee: LG Electronics Inc. (KR)

( * ) Notice: Subject to any disclaimer, the term of this patent is extended or adjusted under 35 U.S.C. 154(b) by 14 days.

(21) Appl. No.: 10/117,961

(22) Filed: Apr. 5, 2002

(65) Prior Publication Data

US 2003/0043583 A1 Mar. 6, 2003

(30) Foreign Application Priority Data

Aug. 30, 2001 (KR) ..... 2001-52910
Nov. 23, 2001 (KR) ..... 2001-73506
Nov. 23, 2001 (KR) ..... 2001-73510

(51) Int. Cl.[7] ..... F21K 2/00

(52) U.S. Cl. ..... 362/263; 362/264; 362/551; 315/85

(58) Field of Search ..... 362/263, 264, 362/551; 315/85

(56) References Cited

U.S. PATENT DOCUMENTS 3,651,319 A * 3/1972 Norris et al. ..... 40/432
4,070,603 A 1/1978 Regan et al. ..... 315/248
4,469,986 A * 9/1984 Tsuchihashi et al. ..... 313/610
5,685,635 A 11/1997 Barthelmess ..... 362/249
5,866,990 A * 2/1999 Ury et al. ..... 315/248

* cited by examiner

*Primary Examiner*—Sandra O'Shea
*Assistant Examiner*—Guiyoung Lee
(74) *Attorney, Agent, or Firm*—Ostrolenk, Faber, Gerb & Soffen, LLP

(57) ABSTRACT

An electrodeless lighting apparatus using microwave comprises: a waveguide for transmitting microwave generated in a magnetron; a mesh screen coupled to an outlet portion of the waveguide for blocking a leakage of the microwave and passing light; a bulb located in the mesh screen for emitting light by generating plasma by the microwave; and a globe installed on outer area of the mesh screen so that the light generated in the bulb can be radiated to omnidirection, that is, the globe is installed around the bulb instead of a reflector and a light guide which are used in the conventional art, and thereby, a structure of the lighting apparatus can be made simply and an omnidirectional lighting can be performed.

14 Claims, 11 Drawing Sheets

GLOBE TYPE ELECTRODELESS LIGHTING APPARATUS

BACKGROUND OF THE INVENTION

1. Field of the Invention

The present invention relates to an electrodeless lighting apparatus, and particularly, to a globe type electrodeless lighting apparatus which is able to extend a lighting area with a simple structure.

2. Description of the Background Art

Generally, an electrodeless lighting apparatus is a device emitting visible rays or ultraviolet rays by radiating microwave to an electrodeless bulb. In addition, the electrodeless lighting apparatus has longer life span than that of an incandescent lamp or a fluorescent lamp, and has superior lighting effect.

FIG. 1 is a longitudinal cross-sectional view showing an electrodeless lighting apparatus according to the conventional art.

As shown therein, the conventional electrodeless lighting apparatus comprises: a case 10; a high voltage generator 20 installed in the case 10 for generating high voltage; a magnetron 30 installed in the case 10 apart a certain distance from the high voltage generator 20 for generating microwave using the high voltage generated in the high voltage generator 20; a waveguide 40 for guiding the microwave generated in the magnetron 30; an electrodeless bulb 60 protruded in front of the waveguide 40 for emitting light as a material filled in the bulb 60 becomes plasma by the microwave energy; and a mesh screen 50 covered on front side of the bulb 60 for blocking the microwave and passing the light emitted from the bulb 60.

Also, the lighting apparatus comprises: a mirror 70 installed on an outlet portion of the waveguide 40 for reflecting the light generated in the bulb 60 to frontward; and a reflector 80 installed on outer side of the case 10 for reflecting the light generated in the bulb 60.

On the other hand, the case 10 includes a bulb motor 90 for rotating the bulb 60, and a bulb shaft 91 for connecting the bulb motor 90 to the bulb 60. Also, a cooling fan 100 for releasing heat generated in the high voltage generator 20 and in the magnetron 30 and a fan motor 101 for driving the cooling fan 100 are installed in the case 10. In addition, an air guide 110 for guiding an air flow generated by the cooling fan 100 to the high voltage generator 20 and to the magnetron 30 is included in the case 10.

An operation of the electrodeless lighting apparatus according to the conventional art constructed as above will be described as follows.

When an electric source is applied to the high voltage generator 20, the magnetron 30 generates microwave by the high voltage generated in the high voltage generator 20. The microwave generated in the magnetron 30 is transmitted into the mesh screen 50 through the waveguide 40 to discharge the material filled in the bulb 60, and thereby plasma is generated.

The light emitted by generating plasma in the bulb 60 is reflected on the mirror 70 and the reflector 80 and radiated to frontward.

At the same time, the bulb motor 90 is operated to rotate the bulb 60, and accordingly, the bulb 60 is cooled down. In addition, the bulb motor 90 is operated to rotate the cooling fan 100, and accordingly, outer air is induced through the air guide 110 to cool down the high voltage generator 20 and the magnetron 30.

On the other hand, as shown in FIG. 2, the reflector 80 which reflects the light generated in the bulb 60 comprises a parabola surface portion 81 including an opening hole 83 formed on front surface, and a coupling portion 82 extended from a rear part of the parabola surface portion 81 and coupled to the case 10.

The reflector 80 is made using a metal material, and a reflection film is coated on an inner surface of the parabola surface portion 81.

The coupling portion 82 of the reflector 80 is fixedly coupled to the case 10, and at that time, the bulb 60 and the mesh screen 50 are located inside of the reflector 80.

In addition, a light guide 120 of long cylinder shape having a diameter corresponding to the diameter of the opening hole 83 of the reflector in order to illuminate outdoor and indoor with the light generated in the bulb 60 is coupled so as to be connected to the opening hole 83 of the reflector 80. One or more light guide 120 may be coupled.

In the above structure of the lighting apparatus, the light generated in the bulb 60 is reflected on the mirror 70 and the reflector 80, and then goes to the light guide 120. And the outdoor or indoor is illuminated as the light reflected on the mirror 70 and the reflector 80 passes through the light guide 120.

However, according to conventional electrodeless lighting apparatus, the reflector 80 and the light guide 120 should be included in order to illuminate the outdoor or the indoor, and therefore, initial cost is increased. In addition, lengths of the reflector 80 and the light guide 120 are very long, and therefore, it needs a large installation area, and the installation area is limited.

Also, the reflector 80 is formed to have parabola cross section for reflecting the light straightly, and therefore, the reflector 80 is heated by the heat generated from the bulb 60 which is located inside of the reflector 80. In addition, a life span is reduced by the heat of the reflector 80.

SUMMARY OF THE INVENTION

Therefore, an object of the present invention is to provide a globe type electrodeless lighting apparatus which is able to illuminate omnidirection with a simple structure.

Another object of the present invention is to provide a globe type electrodeless lighting apparatus which is able to minimize glaring phenomenon and to release the heat generated therein by installing an irregularly reflecting globe around a bulb.

Still another object of the present invention is to provide a globe type electrodeless lighting apparatus which is able to prevent globe from being distorted or being reduced its life span by the heat generated in the bulb.

To achieve these and other advantages and in accordance with the purpose of the present invention, as embodied and broadly described herein, there is provided a globe type electrodeless lighting apparatus comprising: a waveguide for transmitting microwave which is generated in a magnetron; a mesh screen coupled on an outlet portion of the waveguide for blocking a leakage of the microwave and passing the light; a bulb located in the mesh screen for emitting light as generating plasma by the microwave; and a globe installed outer periphery of the mesh screen so that the light generated in the bulb to omnidirections.

Also, the globe is formed using a material having irregularly reflecting characteristic, 50%~95% light permeability, and heat resistance temperature of higher than 100° C.

A location of the bulb and a shape of the globe are decided so that an illuminating angle can be larger than 270° C. centering around the bulb.

The waveguide is fixed on inside of the case, and the globe is fixed on outer side of the case. In addition, the globe of spherical or polyhedral shape comprises a permeation portion through which the light passes, and a mounting portion extended from the permeation portion as a cylindrical shape and coupled to the case.

According to an embodiment of the present invention, the globe may be formed as a sphere or a polyhedron.

According to another embodiment of the present invention, the globe includes a plurality of fine protrusions at least one surface between an inner surface and an outer surface of the globe.

The fine protrusion is formed as a pentahedron or as a hemisphere.

According to still another embodiment of the present invention, a heat blocking member is installed between the bulb and the globe which is close to the bulb so that the heat transmitted from the bulb can be blocked.

The heat blocking member of ring shape comprises a plurality of louvers located between the mesh screen and the globe, and the plurality of louvers are connected to each other using connecting portions.

The louver is formed to have a structure which is gradually enlarged toward the front side.

According to the electrodeless lighting apparatus of the present invention as described above, the structure of the lighting apparatus can be simple and omnidirectional lighting effect can be performed by installing the globe around the bulb instead of using a reflector and a light guide.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Figure 1:
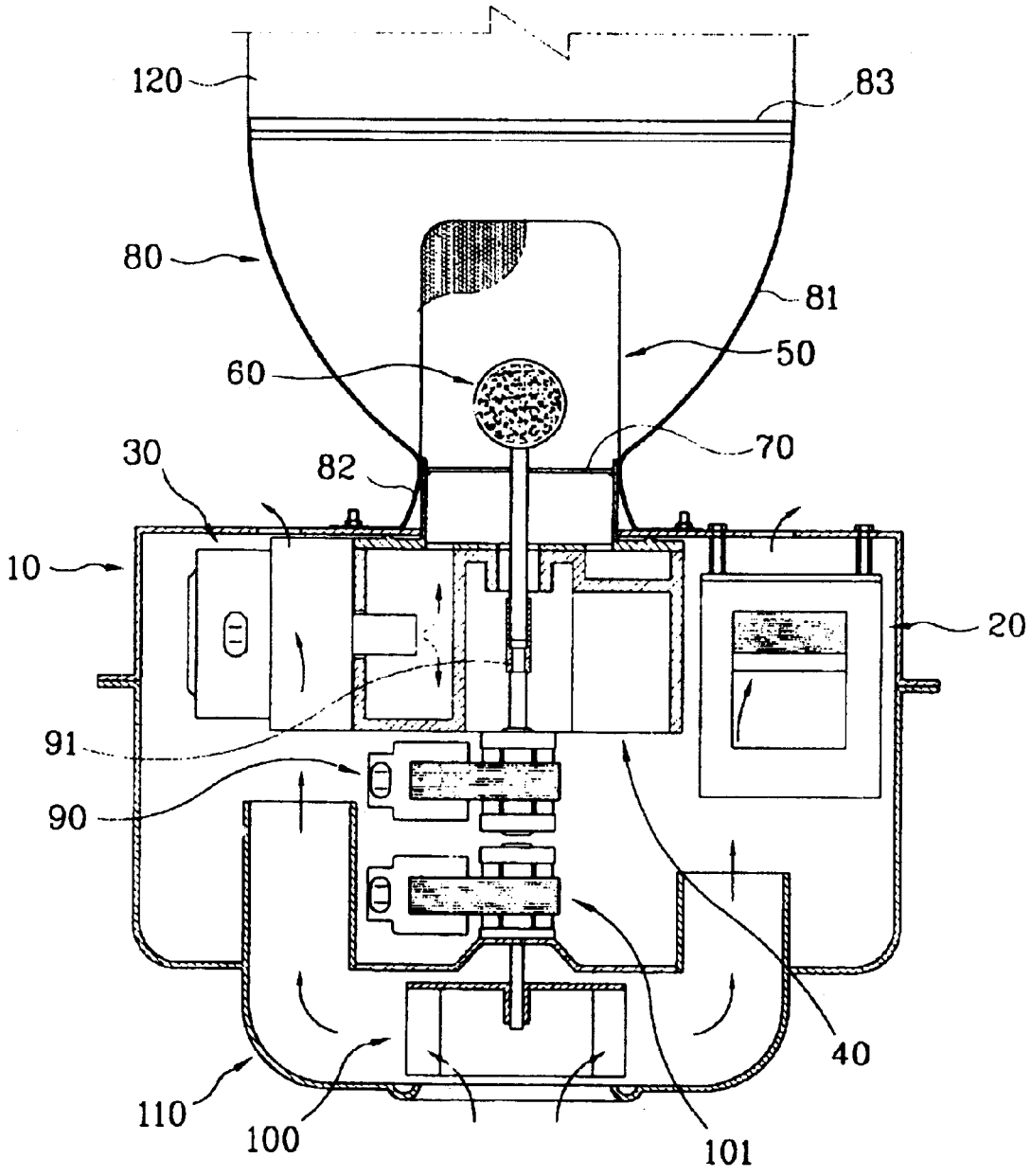
FIG. 1 PRIOR ART
FIG. 1 is a longitudinal cross-sectional view showing an electrodeless lighting apparatus according to the conventional art.
Figure 2:
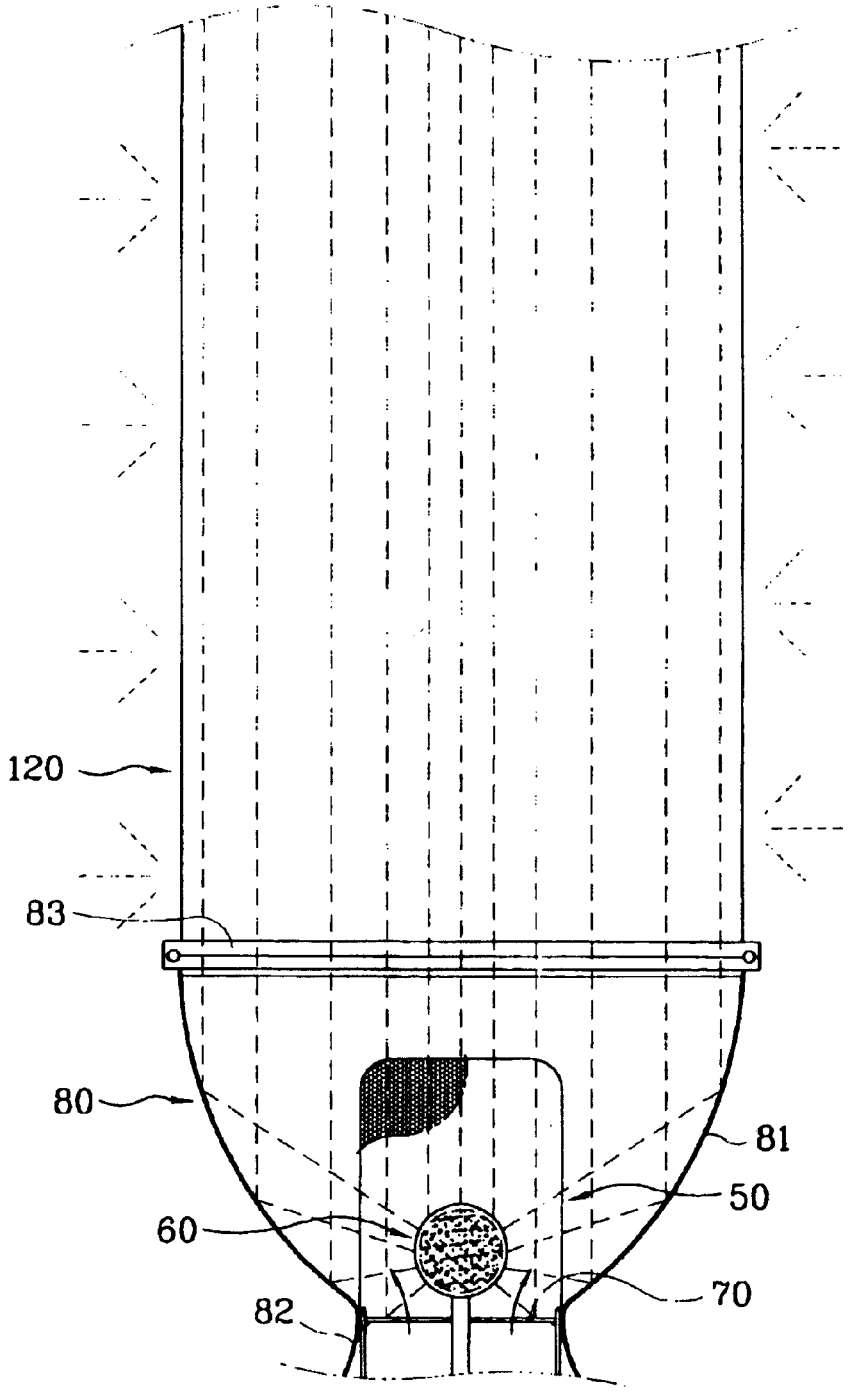
FIG. 2 PRIOR ART
FIG. 2 is a cross-sectional view showing a state that a light guide is connected to the conventional lighting apparatus.

Reference will now be made in detail to the preferred embodiments of the present invention, examples of which are illustrated in the accompanying drawings.

For same components as those of the conventional art, same reference numerals are used.

Figure 3:
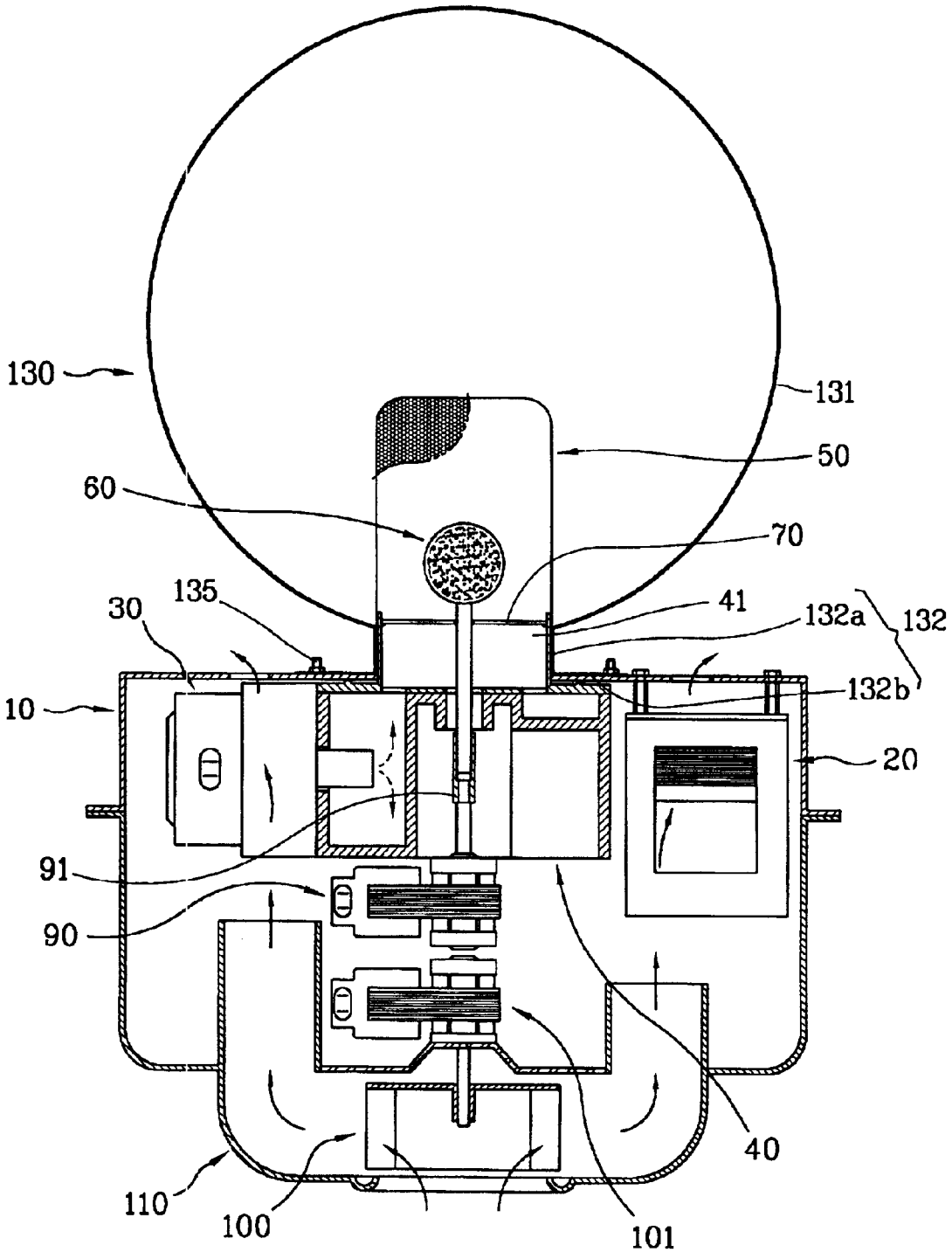
FIG. 3 is a longitudinal cross-sectional view showing an electrodeless lighting apparatus according to a first embodiment of the present invention.
Figure 4:
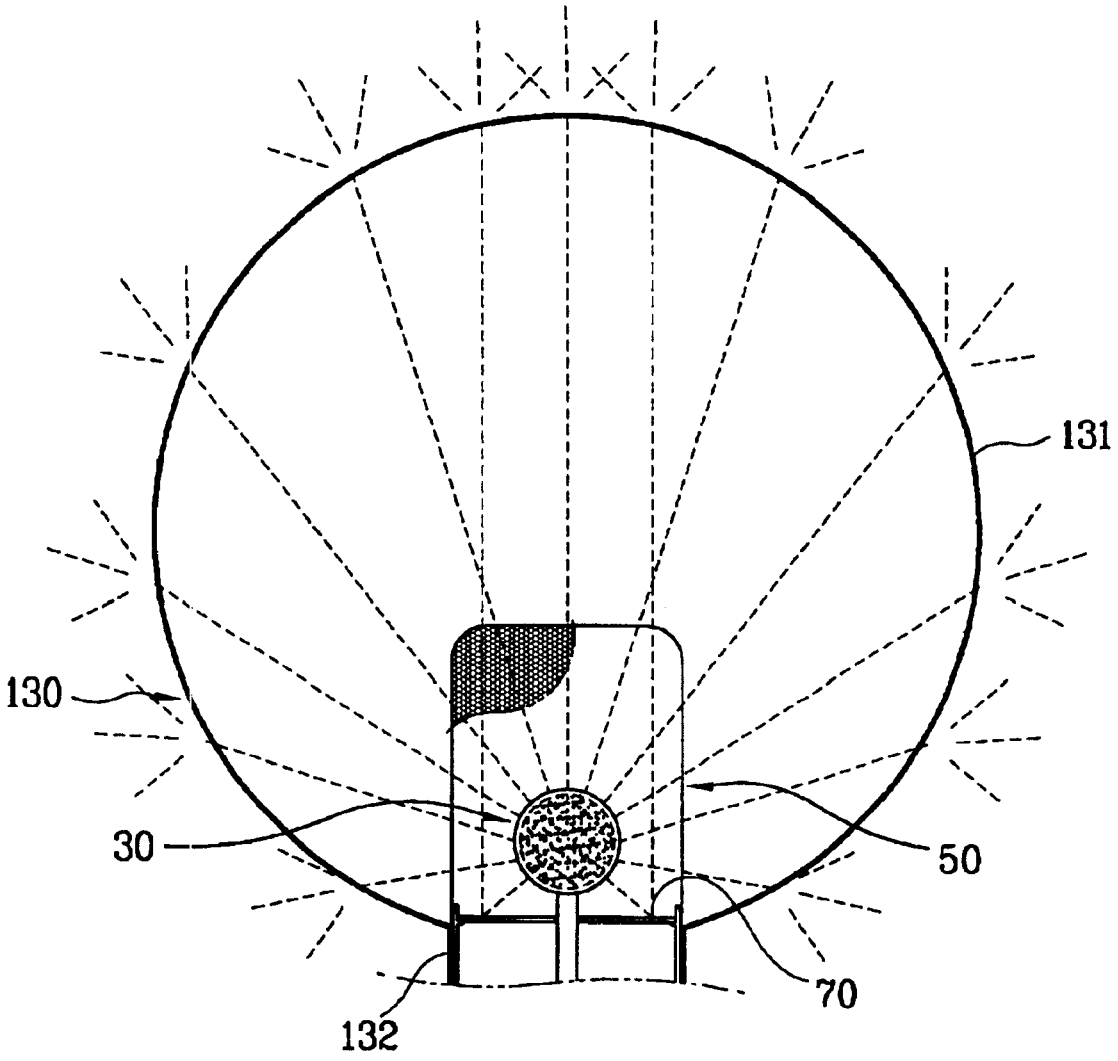
FIG. 4 is a cross-sectional view showing operation state of principal parts in the electrodeless lighting apparatus according to the first embodiment of the present invention.

FIG. 3 is a longitudinal cross-sectional view showing an electrodeless lighting apparatus according to a first embodiment of the present invention.

As shown therein, the electrodeless lighting apparatus according to the first embodiment of the present invention comprises: a high voltage generator 20 for generating high voltage mounted on inner front surface of a case 10; and a magnetron 30 located on a position a predetermined distance apart from the high voltage generator 20 for generating microwave by being transmitted the high voltage generated in the high voltage generator 20.

In addition, a waveguide 40 for transmitting the microwave generated in the magnetron 30 is installed between the magnetron 30 and the high voltage generator 20, and a mesh screen 50 for forming a resonating region of the microwave transmitted from the waveguide 40 is installed on an outlet portion 41 of the waveguide 40.

Herein, the mesh screen 50 is formed as a cylinder having a mesh structure so as to block the microwave and pass the light.

In addition, a bulb 60, in which illuminant materials are filled, is located in the mesh screen 50, and the filled material may include metal which emits light as generating plasma by the microwave.

A bulb motor 90 for rotating the bulb 60 and a bulb shaft 91 for connecting the bulb motor 90 to the bulb 60 are included in the case 10. In addition, a cooling fan 100 and a fan motor 101 driving the fan 100 are installed on the case 10 in order to release the heat generated from the high voltage generator 20 and the magnetron 30, and an air guide 110 for guiding an air flow generated by the cooling fan 100 to a direction of the high voltage generator 20 and the magnetron 30 is included.

Especially, a globe 130 which is formed as a sphere so as to cover the mesh screen 50 is installed on a front surface of the case 10. Therefore, the mesh screen 50 is located inside of the globe 130, and the bulb 60 is located in the mesh screen 50.

The globe 130 of spherical shape comprises a permeation portion 131 through which the light is permeated to outside, and a mounting portion 132 protruded from the permeation portion 131 and coupled to the case 10. Herein, the mounting portion 132 includes a neck portion **132*a* which is inserted into an outer side of the outlet portion 41 on the waveguide 40, and a flange portion 132*b* which is extended to a radial direction so as to be coupled to the case 10 using a bolt 135 and fixed thereon is formed on an end of the neck portion 132*a***.

It is desirable that the globe 130 is formed using an irregularly reflecting material such as polymer. In addition, it is desirable that a permeability of the material is 50%~95%, and a heat resistance temperature is 100° or more.

On the other hand, a mirror 70 for reflecting the light generated in the bulb 60 forward is mounted on a rear side of the bulb 60 in the outlet portion of the waveguide 40. The microwave can be passed through the mirror 70.

In addition, it is desirable that the location of the bulb 60 and the shape of the globe 130 are decided so that a lighting angle is to be 270°.

An operation and an effect of the electrodeless lighting apparatus according to the first embodiment of the present invention will be described as follows.

When an electric source is applied to the high voltage generator 20, the magnetron 30 generates microwave by the high voltage generated in the high voltage generator 20. The microwave generated in the magnetron 30 is transmitted into the mesh screen 50 through the waveguide 40, and then, a strong microwave electric field is generated in the mesh screen 50 to generate plasma as exciting the material filled in the bulb 60.

The light emitted by the plasma generated in the bulb 60 is permeated through the globe 130 formed as a sphere, and then radiated to omnidirection in the lighting area. In addition, the light radiated to a rear direction of the bulb 60 is reflected forward by the mirror 70, and then radiated to outer side after permeating the globe 130.

Herein, the globe 130 is made by the irregularly reflecting material, and therefore, the light permeating the globe is irregularly reflected to omnidirection. Therefore, the glaring phenomenon that a user in the lighting area may feel can be minimized.

On the other hand, as the electric source is applied, the bulb motor 90 is operated to rotate the bulb 60, and thereby, the bulb 60 is cooled down. Also, the fan motor 101 is operated and rotates the cooling fan 100, and accordingly, the outer air is induced into the case 10 through the air guide 100 to cool down the high voltage generator 20 and the magnetron 30.

In the electrodeless lighting apparatus according to the present invention, the light emitted as the material filled in the bulb 60 becomes plasma by the microwave is the light having same characteristics as those of natural rays such as visible rays or ultraviolet rays. As described above, the light generated in the bulb 60 permeates the globe 130 of spherical shape and illuminated indoors or outdoors, and therefore, the light is radiated to omnidirection.

Also, the globe 130 is made using the irregularly reflecting material, and therefore, the light emitted from the bulb 60 is irregularly reflected as passing through the globe 130. Thereby the glaring phenomenon that the user may feel can be minimized.

Also, according to the present invention, the light generated in the bulb 60 is radiated to outer side using the globe 130, and therefore, the omnidirectional lighting can be made and the entire structure of the lighting apparatus can be simplified. That is, according to the conventional art, the light guide 120 should be included in the lighting apparatus as shown in FIG. 1, however, the present invention requires only the globe 130. Therefore, the entire structure of the lighting apparatus can be constructed simply.

Figure 5:
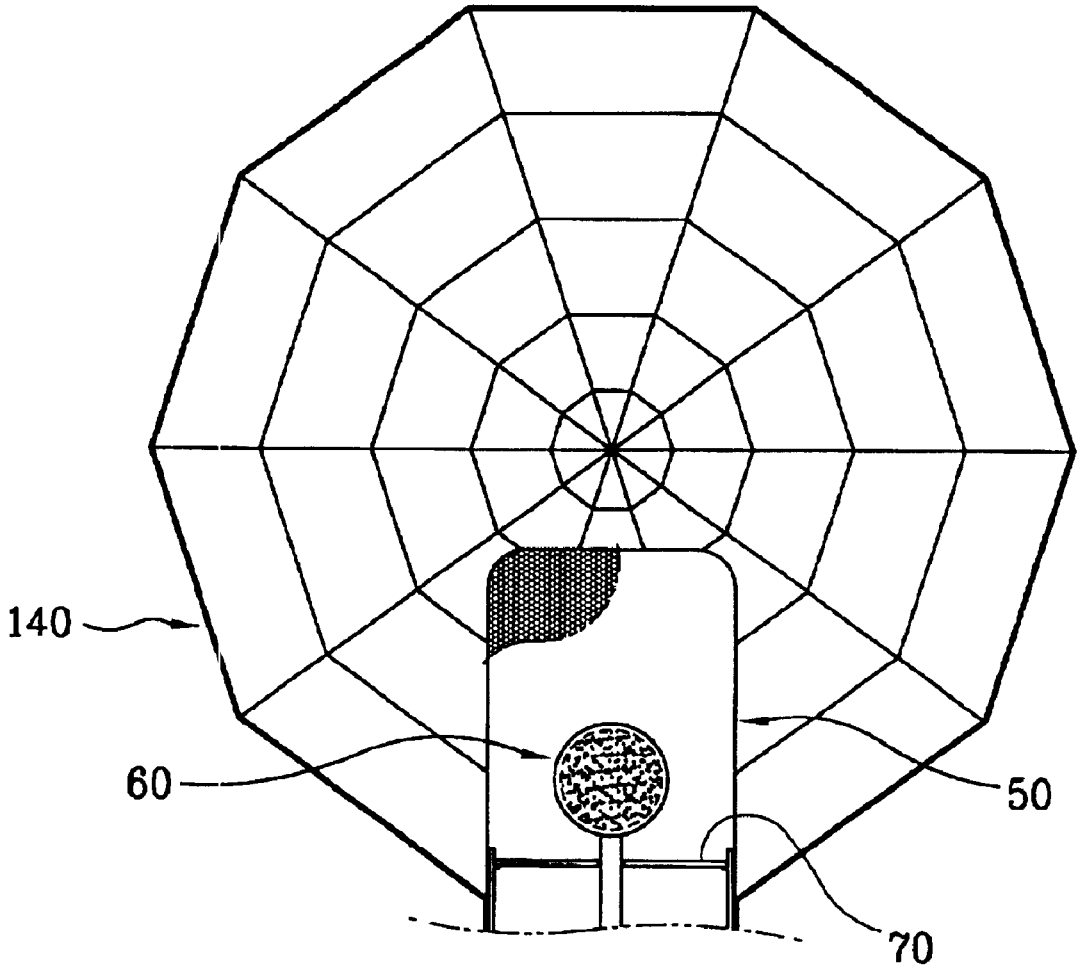
FIG. 5 is a cross-sectional view showing principal parts of an electrodeless lighting apparatus according to a second embodiment of the present invention.

FIG. 5 is a cross-sectional view showing principal parts of an electrodeless lighting apparatus according to a second embodiment of the present invention.

The lighting apparatus according to the second embodiment of the present invention has same construction as that of the lighting apparatus of the first embodiment except a shape of a globe 140.

That is, the globe 130 in the first embodiment is formed as a pure sphere, however, the globe 140 of the second embodiment is formed as a polyhedron having a plurality of planes as shown in FIG. 5.

The polyhedron globe 140 is also formed using an irregularly reflecting material same as the first embodiment, and it is desirable that the material has 50%~95% light permeability, and 100° C. heat resistance temperature.

Herein, the shape of the polyhedron globe 140 is not limited to the shape shown in FIG. 5, however, may be formed variously such as a hexahedron, or an octahedron besides the tetrahedron shown in FIG. 5.

In the electrodeless lighting apparatus according to the second embodiment of the present invention, the light emitted from the bulb 60 is omnidirectionally reflected through the polyhedron globe 140 formed as a polyhedron shape, and illuminates the lighting area.

Figure 6:
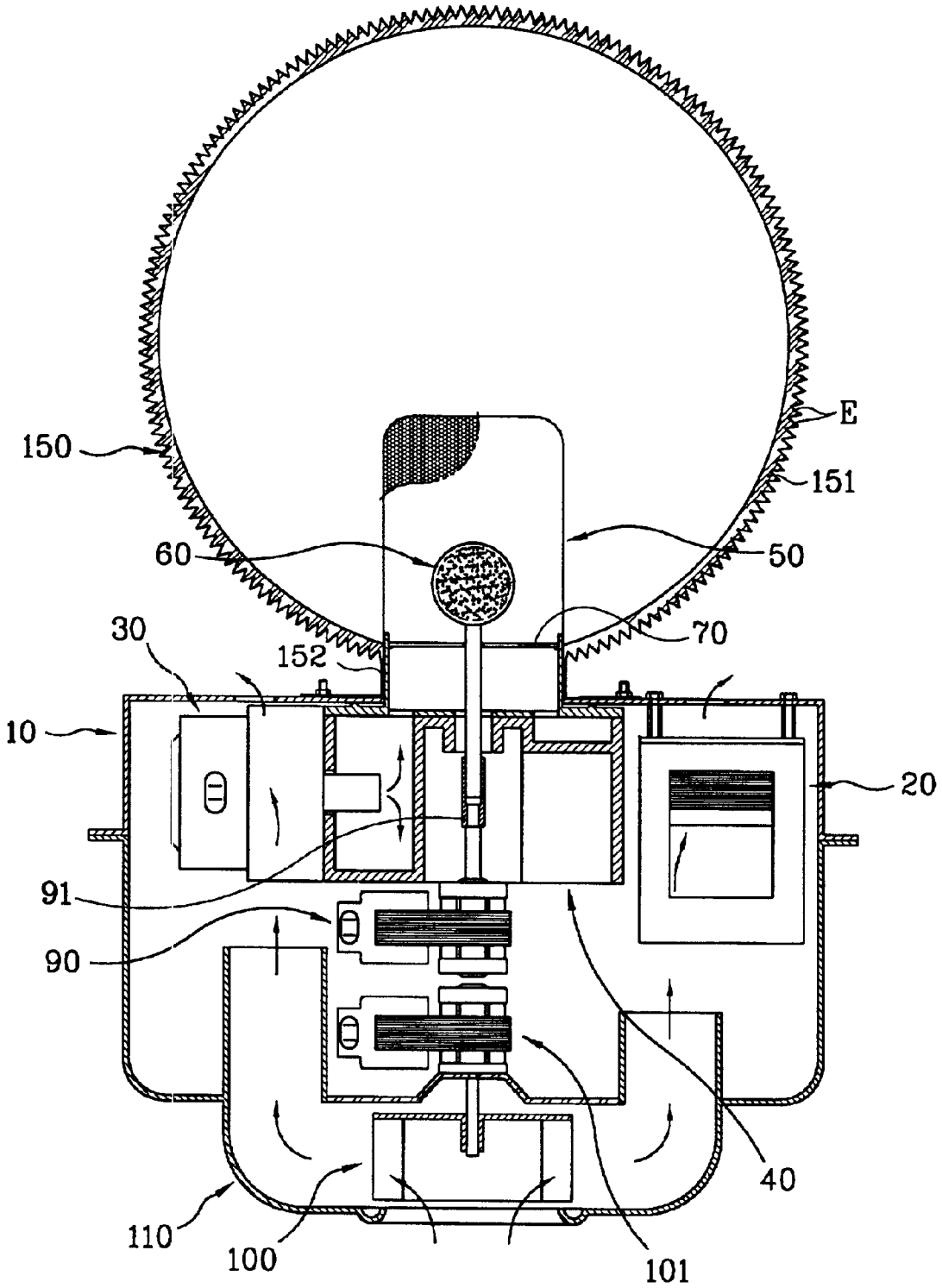
FIG. 6 is a longitudinal cross-sectional view showing an electrodeless lighting apparatus according to a third embodiment of the present invention.

FIG. 6 is a longitudinal cross-sectional view showing an electrodeless lighting apparatus according to a third embodiment of the present invention.

The electrodeless lighting apparatus according to the third embodiment of the present invention comprises: a high voltage generator 20 for generating high voltage in a case 10; a magnetron 30 for generating microwave by being transmitted the high voltage from the high voltage generator 20; and a waveguide 40 for guiding the microwave generated in the magnetron 30.

Also, a bulb motor 90 and a bulb shaft 91 for rotating the bulb 60, a cooling fan 100 and a fan motor 101 for cooling down inner components, and an air guide 110 are included in the case 10.

In addition, a mesh screen 50 of mesh structure so as to block the microwave and pass the light formed on an outlet portion of the waveguide 40, and a bulb 60 for generating the light by the microwave in the mesh screen are installed on a front side of the case 10.

Especially, a globe 150 according to the third embodiment of the present invention includes a plurality of fine protrusions (E) formed on an outer surface of the globe 150, unlike the above first and second embodiments.

The globe 150 of spherical shape comprises a permeation portion 151 through which the light generated in the bulb 60 permeates to outer side by forming fine protrusions (E) on the outer surface of the globe 150, and a mounting portion 152 extended from the permeation portion 151 and coupled to the case 10.

Herein, the mounting portion 152 is constructed as same as the mounting portion of the first embodiment.

Figure 7:
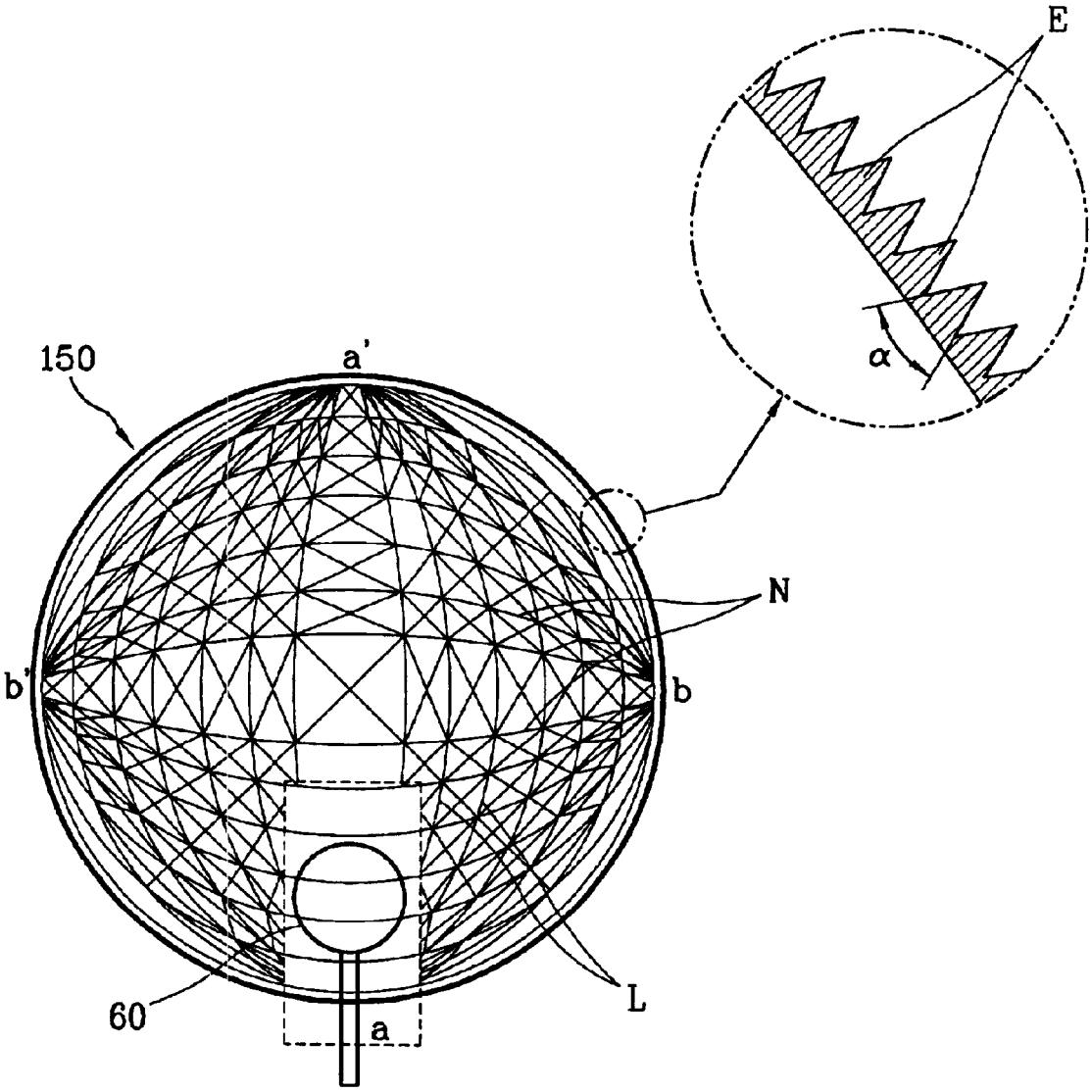
FIGS. 7 and 8 are views showing various modified embodiments of the electrodeless lighting apparatus according to the third embodiment of the present invention.

In addition, the fine protrusions (E) formed on the permeation portion 151 are formed to be protruded as a pentahedron on a crossed areas of vertical corrugations (L) and horizontal corrugations (N), as shown in FIG. 7.

Herein, the vertical corrugations (L) are formed with a predetermined distance therebetween making a vertical shaft, which connects a point (a) on the side where the bulb 60 locates and a point (a') facing the point (a), a standard. In addition, the horizontal corrugations (N) are formed with a predetermined distance therebetween making a horizontal shaft which has a phase of 90° with the vertical shaft a standard.

It is desirable that an apex angle ($\alpha$) of the fine protrusion of pentahedron shape is 70°~130°, and a distance between the bases is 5 mm or less.

Figure 8:
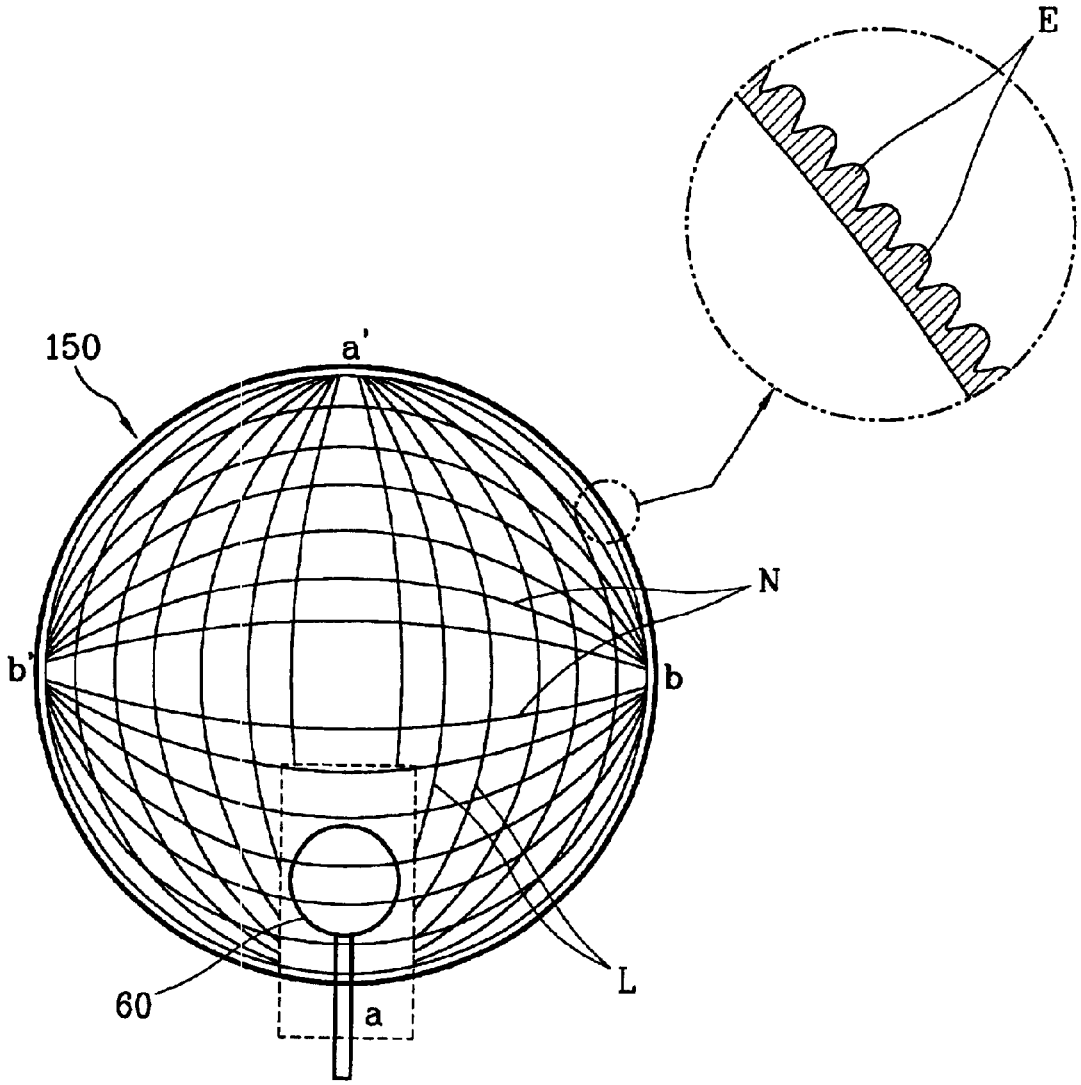

As a modified example of the fine protrusions (E) of pentahedron shape, the fine protrusion may be protruded as a hemisphere shape on the crossed area of the vertical corrugations (L) and the horizontal corrugations (N), as shown in FIG. 8.

It is desirable that the globe is formed using the irregularly reflecting material such as the polymer, the light permeability is 50%~95%, and the heat resistance temperature is 100° C. or more.

Figure 9:
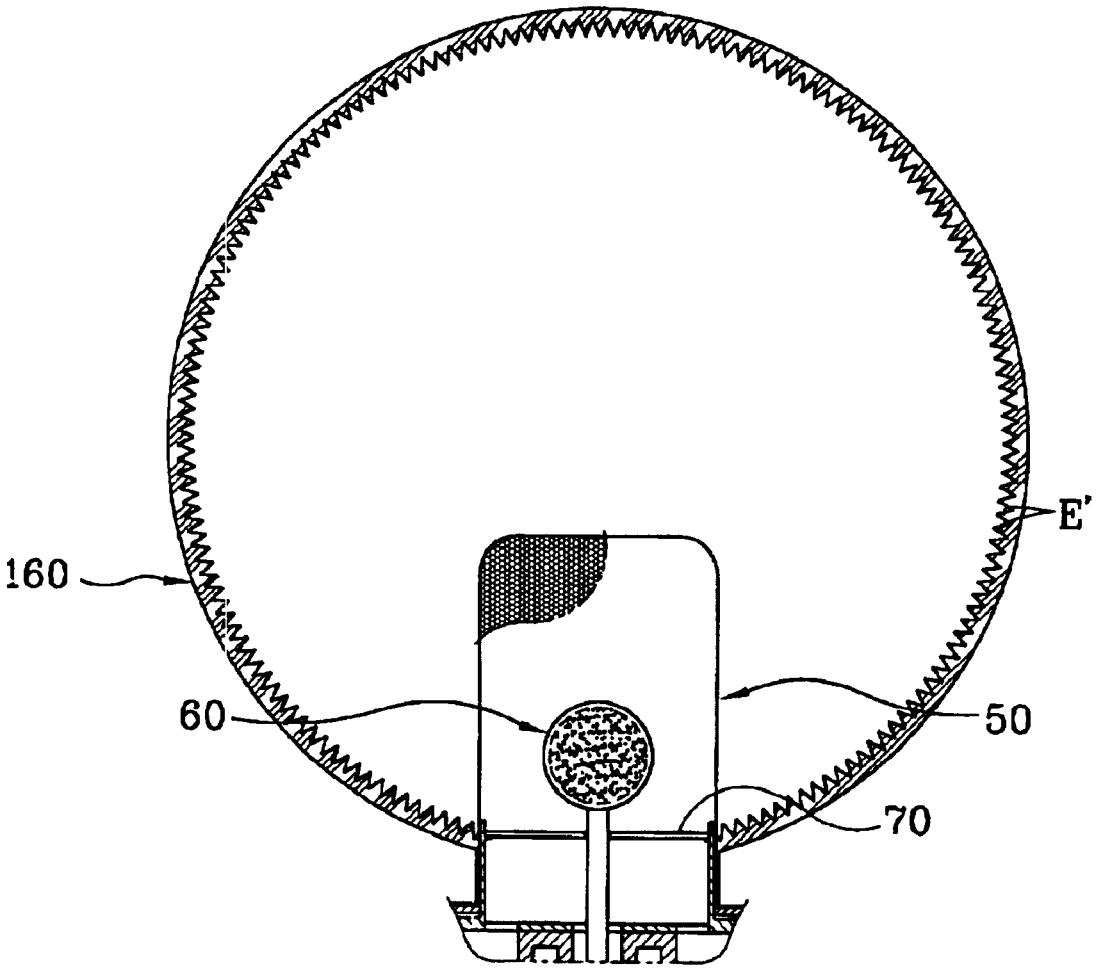
FIG. 9 is a cross-sectional view showing an electrodeless lighting apparatus according to a fourth embodiment of the present invention.

FIG. 9 is a cross-sectional view showing principal parts of an electrodeless lighting apparatus according to a fourth embodiment of the present invention.

A structure of the electrodeless lighting apparatus according to the fourth embodiment of the present invention is similar to that of the third embodiment, however, the fine protrusions (E') formed on the globe 160 are successively formed on an inner surface of the globe 160.

The fine protrusion (E') is formed to have a pentahedron shape having an apex or have a hemisphere shape, as in the third embodiment.

Operations and effects of the electrodeless lighting apparatus according to the third and forth embodiments of the present invention will be described as follows.

When the microwave generated in the magnetron 30 is transmitted to the mesh screen 50 through the waveguide 40, then, the plasma is generated in the bulb 60 to emit the light.

The light emitted from the bulb 60 passes through the mesh screen 50 having a mesh structure, and then radiated to outer side through the globe 150 or 160.

At that time, the fine protrusions (E or E') are formed on the globe 150 or 160, and therefore, these are functioned as irregular reflection by forming various permeance angles when the light passes through the globe 150 or 160. Therefore, the glaring phenomenon that the user in the lighting area may feel can be reduced.

Also, the fine protrusions (E or E') on the globe 150 or 160 form large entire surface area, and therefore, the heat releasing area is large. Therefore, the heat generated in the globe 150 or 160 during using the lighting apparatus can be released smoothly, and therefore, heating of the bulb 60 and the globe 150 or 160 can be prevented.

Figure 10:
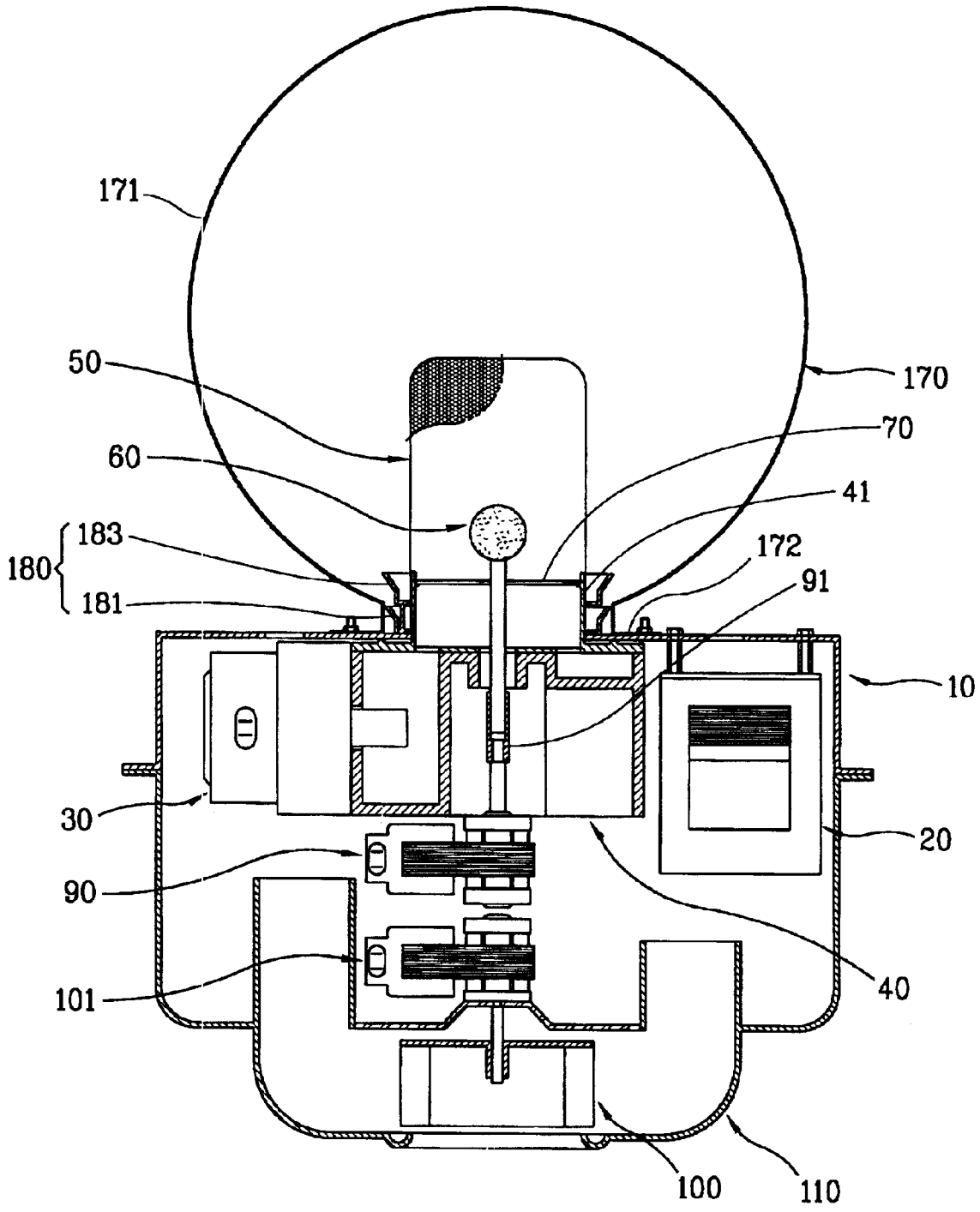
FIG. 10 is a cross-sectional view showing an electrodeless lighting apparatus according to a fifth embodiment of the present invention.
Figure 11:
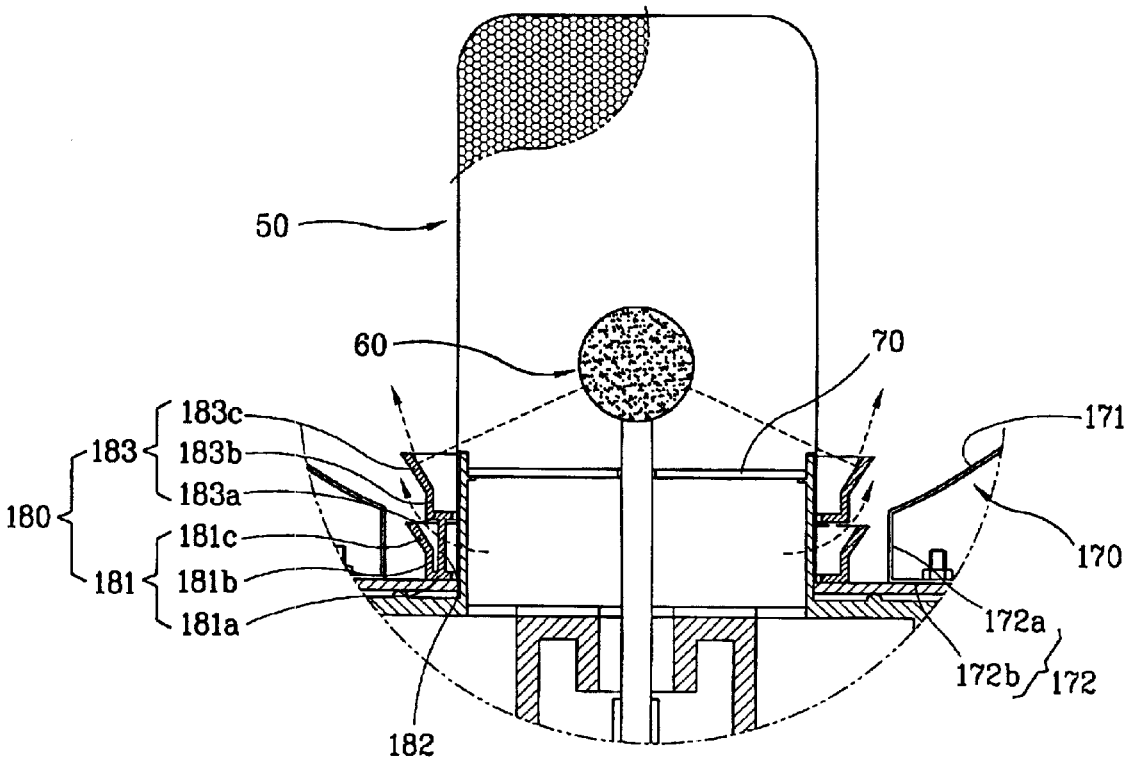
FIG. 11 is a cross-sectional view showing an operation state of the electrodeless lighting apparatus according to the fifth embodiment of the present invention.

FIG. 10 is a cross-sectional view showing an electrodeless lighting apparatus according to a fifth embodiment of the present invention, and FIG. 11 is a cross-sectional view showing an operation state of the electrodeless lighting apparatus according to the fifth embodiment of the present invention.

The electrodeless lighting apparatus according to the fifth embodiment comprises a high voltage generator 20, a magnetron 30, a waveguide 40, a bulb motor 90 and a bulb shaft 91, a cooling fan 100 and a fan motor 101, and an air guide 110 installed in a case 10, same as the structure of the previously described embodiments.

Also, a mesh screen 50 and a bulb 60 are installed in front of the case 10 same as in the previous embodiments.

However, according to the fifth embodiment of the present invention, a heat blocking louver 180 for preventing a globe from being heated by the heat generated from the bulb is disposed between the mesh screen 50 and the globe 170.

Herein, the globe 170 comprises a permeation portion 170 having spherical shape, and a mounting portion 172 extended from the permeation portion 171 to be inserted into the outlet portion 41 of the waveguide 40 and coupled to the case 10.

The mounting portion 172 comprises a neck portion 172*a* of cylindrical shape, and a flange portion 172*b* extended from the neck portion 172*a* to radial direction, as shown in FIG. 11. And the neck portion 172*a* is formed to have an inner diameter which can be apart a certain distance from the outlet portion 41 of the waveguide 40 so that the heat blocking louver 180 can be installed.

Referring to FIG. 11, the heat blocking louver 180 comprises a first louver portion 181 of a ring shape fixedly coupled to the case 10 for blocking the heat by interrupting between the mesh screen 50 and the globe 170; a second louver portion 183 of a ring shape for blocking the heat by interrupting between the mesh screen 50 and the globe 170 at a position apart from the first louver portion 181; and a connecting portion 182 for connecting the first louver portion 181 and the second louver portion 183.

The first louver portion 181 is located between the inside of the neck portion 172*a* in the globe 170 and a periphery of the mesh screen 50, and the second louver portion 183 is located on a position on a straight line which connects the bulb 60 and the neck portion 172*a* of the globe 170.

In addition, the connecting portions 182 is formed as a bar having both ends connected to the first louver portion 181 and to the second louver portion 183 so as to connect the first louver portion 181 and the second louver portion 183 with a predetermined distance therebetween.

Herein, the first louver portion 181 and the second louver portion 183 comprise horizontal portions 181*a* and 183*a* formed in vertical direction for the length direction of the mesh screen 50, vertical portions 181*b* and 183*b* bent from the horizontal portions 181*a* and 183*a* and extended toward the length direction of the mesh screen 50, and slant portions 181*c* and 183*c* extended from the vertical portions 181*b* and 183*b* to be slant toward the direction of widening.

In addition, both ends of the connecting portion 182 are coupled to the horizontal portion 181*a* of the first louver portion 181 and to the horizontal portion 183*a* of the second louver portion 183.

The heat blocking louver 180 has two louver portions in the description above, however, one, two, or more louver portions may be formed according to the conditions.

Operation and effect of the electrodeless lighting apparatus according to the fifth embodiment of the present invention will be described as follows.

When the lighting apparatus is operated, the heat of high temperature is generated during the light emitting process by the bulb 60.

The heat generated in the bulb 60 as described above is blocked by the heat blocking louver 180, and thereby the intensive heating on the globe 170 near the bulb 60 can be prevented.

That is, the bulb 60 is located right over the neck portions 172*a* of the globe due to structural and functional reasons. Therefore, the heat generated when the bulb 60 emits the light is concentrated on the neck portions 172*a* of the globe 170 near the bulb 60 and on the permeation portion 171 connected to the neck portion 172*a*.

At that time, the heat transmitted to the neck portion 172*a* of the globe 170 and to the permeation portion 171 near the neck portion 172*a* is reflected by the first louver portion 181 constituting the heat blocking louver 180, and then, the heat is induced to the permeation portion 171 of the globe which is far from the bulb 60. Thereby, a distortion or a breakdown of the globe 170 near the bulb 60 by being heated intensively can be prevented.

In addition, the second louver portion 183 constituting the heat blocking louver 180 reflects forward the light energy and the heat energy which passed through the mesh screen, and guides the heat blocked by the first louver portion 181 to the front side.

Consequently, the heat blocking louver 180 blocks the heat of high temperature generated from the bulb 60, and thereby prevents the globe from being distorted or damaged.

As described above, according to the electrodeless lighting apparatus of the present invention, the globe is installed around the bulb instead of the reflector and the light guide, and thereby, the structure of the lighting apparatus can be made simply and the omnidirectional lighting can be performed.

Also, according to the electrodeless lighting apparatus of the present invention, the irregular reflection is made when the light emitted from the bulb is passed through the globe, and thereby, the glaring phenomenon is prevented and a comfortable lighting environment can be made.

Also, according to the electrodeless lighting apparatus of the present invention, the fine protrusions are formed on an inner or outer surface of the globe for enlarging the surface area of the globe, and thereby, the light can be reflected irregularly and the heat releasing function is improved. Therefore, the life span of the product can be increased and the reliability of the apparatus can be improved.

Also, according to the electrodeless lighting apparatus of the present invention, the heat blocking louver is installed between the globe and the bulb, and thereby the distortion or breakdown of the neck portions on the globe by the heat generated from the bulb can be prevented. And therefore, the reliability of the apparatus can be improved.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting apparatus comprising:

a waveguide for transmitting microwave generated in a magnetron;

a mesh screen coupled to an outlet portion of the waveguide for blocking a leakage of the microwave and passing light;

a bulb located in the mesh screen for emitting light by generating plasma by the microwave; and a globe installed on outer area of the mesh screen so that the light generated in the bulb can be radiated omnidirectionally, wherein the globe includes a plurality of fine protrusions at least on one of an inner surface and an outer surface thereby.

2. The apparatus of claim 1, wherein the globe is formed as a sphere.

3. The apparatus of claim 1, wherein the globe is formed as a polyhedron.

4. The apparatus of claim 1, wherein the globe is made using an irregularly reflecting material.

5. The apparatus of claim 1, wherein a light permeability of the globe is 50%~95%.

6. The apparatus of claim 1, wherein the globe is made using a material having a heat resistance temperature of 100° C. or more.

7. The apparatus of claim 1, wherein a location of the bulb and a shape of the globe are decided so that a lighting angle is 270° or more centering around the bulb.

8. The apparatus of claim 1, wherein the waveguide is fixed on an inner side of a case, and the globe is fixed on an outer side of the case.

9. The apparatus of claim 8, wherein the globe comprises a permeation portion of spherical or polyhedron shape through which the light passes, and a mounting portion extended from the permeation portion as a cylindrical shape and fixed on the case.

10. The apparatus of claim 1, wherein the fine protrusion is formed as a pentahedron.

11. The apparatus of claim 1, wherein the fine protrusion is formed as a hemisphere.

12. The apparatus of claim 1, wherein a heat blocking member is installed between the bulb and the globe near the bulb so that the heat transmitted from the bulb can be blocked.

13. The apparatus of claim 12, wherein the heat blocking member comprises a plurality of louvers of ring shape located between the mesh screen and the globe, and the plurality of louvers are connected to each other by a connecting portion.

14. The apparatus of claim 13, wherein each of the plurality of louvers has a shape that is enlarged toward a front side thereof.

* * * * *